United States Patent [19]

Kaufeler

[11] Patent Number: 4,808,006

[45] Date of Patent: Feb. 28, 1989

[54] DEVICE TO MAINTAIN SEPARATE UNTIL THE MOMENT OF USE AND THEN TO MIX TWO DIFFERENT SUBSTANCES WITHIN A CONTAINER, PARTICULARLY TWO-COMPONENT RESINS

[75] Inventor: Max Kaufeler, Cadempino, Switzerland

[73] Assignee: Intecser S.A., Cadempino, Switzerland

[21] Appl. No.: 939,404

[22] Filed: Dec. 8, 1986

[30] Foreign Application Priority Data

Dec. 6, 1985 [CH] Switzerland ..... 5189/85

[51] Int. Cl.[4] ..... B65D 25/08; B01F 7/00

[52] U.S. Cl. ..... 366/332; 206/219; 206/222; 222/136; 222/145; 366/130; 366/195; 366/196; 366/333

[58] Field of Search ..... 366/129, 130, 194–196, 366/332, 333; 222/136, 190, 145; 206/219–222

[56] References Cited

U.S. PATENT DOCUMENTS

| | | | |
|---|---|---|---|
| 3,217,946 | 11/1965 | Cook . | |
| 3,370,754 | 2/1968 | Cook et al. | 222/132 |
| 3,735,900 | 5/1973 | Gores | 222/145 |
| 3,756,389 | 9/1973 | Firth . | |
| 4,007,831 | 2/1977 | Bernhardt | 206/219 |
| 4,153,156 | 5/1979 | Seemann et al. | 206/219 |
| 4,182,447 | 1/1980 | Kay | 206/220 |
| 4,211,019 | 7/1980 | McCafferty | 206/219 X |
| 4,239,105 | 12/1980 | Gilbert | 206/219 |
| 4,253,566 | 3/1981 | Seemann | 206/222 X |
| 4,265,216 | 5/1981 | Marshall et al. | 206/222 X |
| 4,272,199 | 6/1981 | Hade | 366/333 X |
| 4,291,799 | 9/1981 | Bower, Jr. | 206/219 |
| 4,343,399 | 8/1982 | Patel et al. | 206/222 |
| 4,353,463 | 10/1982 | Seemann | 206/222 X |
| 4,371,094 | 2/1983 | Hutter, III | 366/333 X |
| 4,496,046 | 1/1985 | Stone et al. | 206/219 |
| 4,509,641 | 4/1985 | Scieri et al. | 206/219 |
| 4,519,499 | 5/1985 | Stone et al. | 206/219 |
| 4,534,509 | 8/1985 | Holzner . | |
| 4,676,655 | 6/1987 | Handler | 366/332 X |

FOREIGN PATENT DOCUMENTS

| | | |
|---|---|---|
| 0868702 | 1/1979 | Belgium . |
| 0880573 | 4/1980 | Belgium . |
| 0880866 | 4/1980 | Belgium . |
| 0892021 | 5/1982 | Belgium . |
| 0034620 | 9/1981 | European Pat. Off. . |
| 2848083 | 5/1980 | Fed. Rep. of Germany . |
| 3416094 | 10/1985 | Fed. Rep. of Germany . |
| 2496058 | 6/1982 | France . |
| 1345243 | 1/1974 | United Kingdom . |
| 2104863 | 3/1983 | United Kingdom . |
| 2134067 | 8/1984 | United Kingdom . |

*Primary Examiner*—John Petrakes
*Attorney, Agent, or Firm*—Young & Thompson

[57] ABSTRACT

The device, placed inside of the cartridge, container, tube, etc., makes it possible to maintain two different substances in chambers (6, 7) separate until the moment of use and then makes possible their mixing, and distribution of the mixture from a closeable (3) output opening (2) of cartridge, tube or container (1). The device comprises a membrane (4) easy to perforate or break (10) fastened to a fluidtight peripheral ring (4'). A perforated (13) disk (14) is provided with points (8) or the like for perforating or breaking (10) of membrane (4) at the moment of use. The disk is driven like a piston, by sliding (arrow 12) and/or rotation (arrow 17) of a rod (5) coming in a tight manner from container (1) to allow, by alternating movements, the intimate mixing of the two substances. It is provided, at the site of membrane (4), to introduce into the cartridge, container, tube or the like, a fragile container (spherical, cylindrical or in any other shape) holding one of the two substances, and adapted to be broken at the moment of use.

1 Claim, 2 Drawing Sheets

DEVICE TO MAINTAIN SEPARATE UNTIL THE MOMENT OF USE AND THEN TO MIX TWO DIFFERENT SUBSTANCES WITHIN A CONTAINER, PARTICULARLY TWO-COMPONENT RESINS

This invention has as its object a process to maintain separate until the moment of use, within a cartridge, container, tube or the like, two different substances that are liquid, paste or solid, in powder or granular form, and particularly two-component resins, to mix them at the moment of use and distribute them.

It also relates to a device for embodying the process.

It does not appear to the applicant that processes and devices according to the invention are known.

Figure 1:
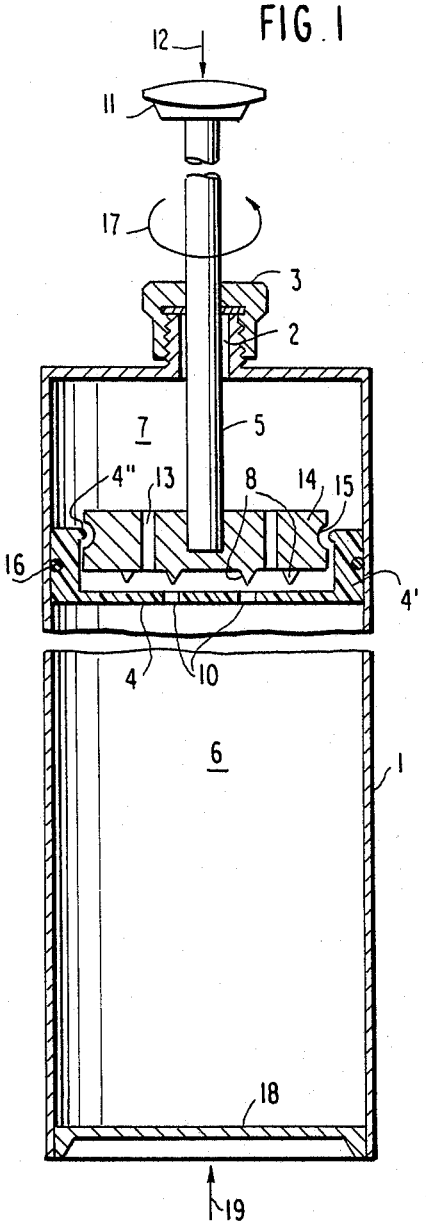
Figure 3:
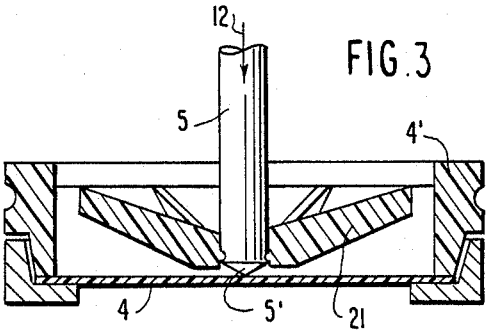
Figure 5:
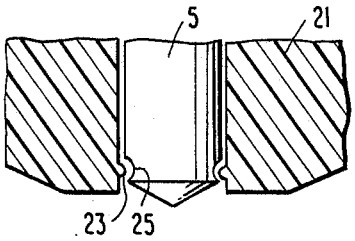
Figure 4:
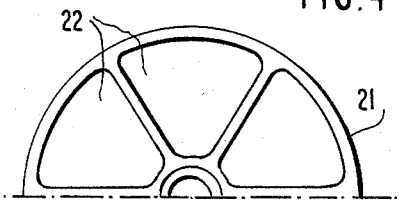
Figure 6:
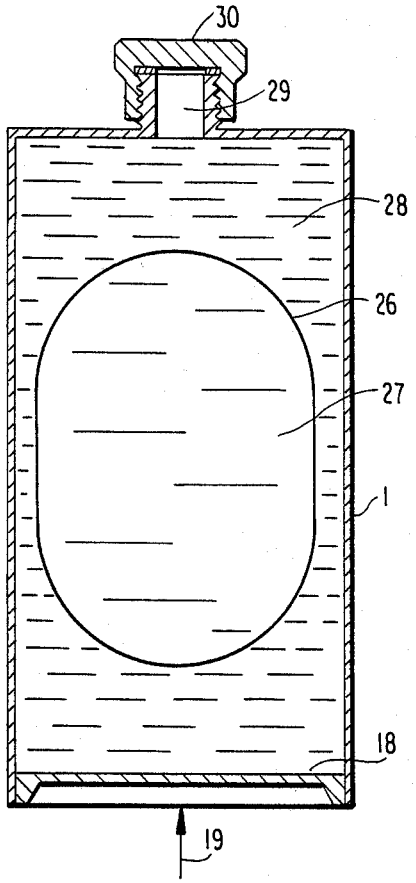

The accompanying drawing represents:

in FIG. 1 the axial section of a preferred embodiment of the device in question, in a nonlimiting, nonbinding way;

FIG. 2 a variant;

in FIGS. 3, 4, 5 another variant; and in FIG. 6 still another variant.

The device, applied to any cartridge, tube or container 1 (FIG. 1), with an output opening 2 that can be closed by cap 3, makes it possible to create two separate chambers 6, 7 in each of which is contained a substance different from the other, for example, two components of a resin, i.e. resin in 6 and hardener in 7, which must be kept separate until the moment of use and, when it is desired to use them, must be intimately mixed and then distributed through opening 2 after cap 3 and rod 5 are removed.

To achieve this, the device in question comprises membrane 4 which is easy to perforate, made, for example, of synthetic resin or sheet metal, exhibiting annular periphery 4' reinforced, i.e., thickened to allow sliding along the inside walls of container 1.

During storage of all the material, membrane 4 keeps the two substances separate.

At the moment of use, by pressing on handle 11 of rod 5 in the direction of arrow 12 and optionally also by causing rotation in the direction of arrow 17, membrane 4 is perforated by points 8 integral with disk 14.

By repeatedly moving the unit made up of perforated membrane 4 and disk 14 in both directions, axially along container 1, the two liquids in the chambers 6, 7 are drawn from one chamber 6, 7 to the other until the mixing is complete, after which, with cap 3 and rod 5 removed, the mixture is made to come out of opening 2, optionally screwing a flexible distribution tube on the threads of the cap.

Annular periphery 4' of membrane 4 exhibits O ring 16 made, for example, of "Teflon" (polytetrafluoroethylene), neoprene, etc., while ribbing 4" inside ring 4', ribbing which is inserted in complementary annular groove 15 of disk 14, assures the dragging of the entire unit.

Disk 14 exhibits holes 13 that work with holes 10 made in membrane 4 by points 8 to allow the passage of the two liquids contained in chambers 6, 7 from one chamber to the other.

Figure 2:
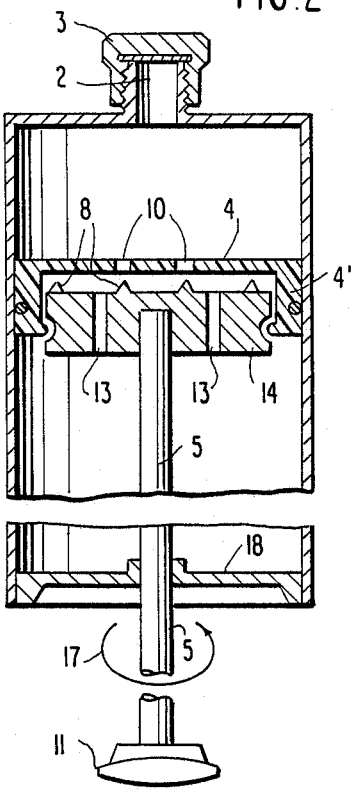

FIG. 2 illustrates a variant according to which rod 5 is introduced in sealed relation through bottom 18.

Said bottom 18 slides also in a tight manner along the inside walls of cartridge, tube or container 1, driven by an ejection piston (not shown) or with compressed air in the direction of arrow 19, after rod 5 is removed.

Perforation points 8 can be replaced by any other means suitable for perforating membrane 4. Rotation of rod 5 makes it possible also to cut the membrane into rings by points 8.

Rod 5 can have a polygonal section and exhibit a side pin to be able to insert it like a bayonet into disk 14 and pull it out when it is necessary to distribute the mixture from opening 2.

FIGS. 3, 4 and 5 show a modified form according to which rod 5 is sharpened to a point 5' and has a annular groove 25 that restrains piston 21 with annular projections 23 on piston 21. Piston 21 is finned and is preferably made of plastic, and is provided with openings 22 shown in FIG. 4. Rod 5 and piston 21 move together as a unit, either to break membrane 4 or to mix the two substances.

Separation of the two different substances, particularly the two components of a synthetic resin, can also be achieved by introducing at the time of filling the container, an inner container that is spherical, cylindrical or any other shape, having walls that are easy to tear or break, for example of glass. This inner container holds one of the two substances or components to be mixed, while the other substance or component placed in the container is outside said tearable or breakable container. This variant is illustrated in FIG. 6.

Thus, as is seen in FIG. 6, there is provided an elongated outer container 1 and a generally oblong easily breakable inner container 26 disposed within outer container 1. Inner container 26 contains one of the components 27 of, say, a synthetic resin, while the other component 28 is contained within outer container 1 but outside inner container 26.

At one end of container 1, there is an outlet opening 29 closed by a removable closure 30. When closure 30 is removed, an object such as rod 5 (of course without any piston on it) can be inserted through opening 29 to rupture inner container 26 and to cause mixing of the two components 27 and 28. When the rod 5 is then removed, the slidable imperforate piston 18 can be pushed in the direction of arrow 19 to dispense the reactive mixture of the two components 27 and 28. As is evident from FIG. 6, therefore, a device of simple construction is thus provided which is sufficiently inexpensive to be discarded after a single use.

Rod 5 (FIG. 3), sharpened to a point at 5', can be unfastened from piston 21 by groove 25 working with projection 23 of piston 21, to break said container, and while joined to piston 21 provided with openings 22 contributes to the mixing.

It is provided that membrane 4 can be a single piece with annular part 4' or the whole can be made in two different parts, joined together.

The thickness of membrane 4 and that of annular part 4' are based on the size (diameter) of tube or container 1 and the aggressiveness of substances in chambers 6, 7 contained in container 1.

Disk 14 can be made, for example, of metal or synthetic resin.

Membrane 4 with disk 14 can be located at any height along the axis of container 1.

I claim:

1. A device to maintain separate until the moment of use and then to mix two different substances, comprising an elongated outer container, and an inner container within the outer container, one of the substances being sealed within the inner container and the other of the substances being within the outer container but outside the inner container, the inner container being readily breakable, one end wall of the elongated outer container being imperforate and slidable in the outer container to dispense the two substances when mixed, the other end wall of the elongated outer container having an opening therethrough for inserting within the outer container and device to break the inner container and to mix the two substances together, and removable closure means closing said opening.

* * * * *